US006821212B2

(12) United States Patent
Fowler et al.

(10) Patent No.: US 6,821,212 B2
(45) Date of Patent: Nov. 23, 2004

(54) DEVICE TO CONVERT A GOLF CLUB INTO A TRAINING SYSTEM

(75) Inventors: Troy Allen Fowler, Cedar Park, TX (US); Clifford Bailey, Cedar Park, TX (US)

(73) Assignee: TruRoll Golf, Inc., Austin, TX (US)

( * ) Notice: Subject to any disclaimer, the term of this patent is extended or adjusted under 35 U.S.C. 154(b) by 0 days.

(21) Appl. No.: 10/218,994

(22) Filed: Aug. 14, 2002

(65) Prior Publication Data

US 2003/0040374 A1 Feb. 27, 2003

Related U.S. Application Data

(60) Provisional application No. 60/315,225, filed on Aug. 27, 2001.

(51) Int. Cl.[7] ..... A63B 69/36

(52) U.S. Cl. ..... 473/236; 473/242; 473/244

(58) Field of Search ..... 473/330, 331, 473/236, 238, 242, 226, 219, 227, 228, 240, 241, 244, 251, 223, 282

(56) References Cited

U.S. PATENT DOCUMENTS

| | | | | | |
|---|---|---|---|---|---|
| 1,536,616 | A | | 5/1925 | Manning | |
| 2,057,821 | A | | 10/1936 | Costello | |
| 2,388,463 | A | | 11/1945 | Benecke | |
| 3,021,141 | A | * | 2/1962 | Polsky et al. | 473/236 |
| 3,194,564 | A | | 7/1965 | Swan | |
| 3,384,376 | A | | 5/1968 | Greenlee | |
| 3,437,341 | A | * | 4/1969 | Hasten et al. | 473/236 |
| 3,758,117 | A | * | 9/1973 | Harrison | 473/231 |
| 3,759,527 | A | | 9/1973 | Witherspoon | |
| 4,025,078 | A | | 5/1977 | Pelz | |
| 4,030,766 | A | * | 6/1977 | Derr | 473/249 |
| 4,067,572 | A | * | 1/1978 | Coleman | 473/245 |
| 4,252,262 | A | | 2/1981 | Igarashi | |
| 4,934,706 | A | * | 6/1990 | Marshall | 473/241 |
| 5,135,228 | A | | 8/1992 | Hawkins, Sr. et al. | |
| 5,207,721 | A | | 5/1993 | Lobdell | |
| 5,240,253 | A | | 8/1993 | Cooper | |
| D353,178 | S | | 12/1994 | Koleoglou | |
| 5,441,268 | A | | 8/1995 | Shier | |
| 5,441,270 | A | | 8/1995 | Williams | |
| 5,467,538 | A | * | 11/1995 | Chou et al. | 33/508 |
| 5,478,078 | A | | 12/1995 | Lee | |
| 5,524,895 | A | | 6/1996 | Nakajima | |
| 5,582,407 | A | | 12/1996 | Sorenson | |
| 5,603,665 | A | | 2/1997 | Bryant | |
| 5,707,297 | A | | 1/1998 | Shu | |
| 5,810,675 | A | | 9/1998 | Weathers | |
| 5,820,477 | A | | 10/1998 | Redkey et al. | |
| 6,146,285 | A | | 11/2000 | Winslow | |
| 6,176,792 | B1 | | 1/2001 | Tate | |
| 6,203,444 | B1 | * | 3/2001 | McRae | 473/244 |
| 6,358,157 | B1 | | 3/2002 | Sorenson | |

* cited by examiner

*Primary Examiner*—Sebastiano Passaniti
(74) *Attorney, Agent, or Firm*—Kenneth C. Brooks

(57) ABSTRACT

The present invention provides a device and method to facilitate use of a golf club, having a face, as a system to improve a user's performance in the game of golf. The device includes a body having first and second opposed surfaces; and a clamping mechanism connected to the body to securely affix the body to the golf club, with the second surface being coextensive with the first surface and having an arcuate shape with a constant radius of curvature.

20 Claims, 5 Drawing Sheets

DEVICE TO CONVERT A GOLF CLUB INTO A TRAINING SYSTEM

CROSS-REFERENCE TO RELATED APPLICATIONS

The present application claims priority from U.S. provisional patent application No. 60/315,225 listing Troy Allen Fowler and Clifford Bailey as inventors. The No. 60/315,225 filed Aug. 27, 2000 provisional patent application is incorporated in its entirety herein.

BACKGROUND OF THE INVENTION

The present invention relates to golf instruments, and more specifically to a method and a device to convert a golf club into a training system.

Golf is a popular sport. It is well-known that mastery of the sport depends, in a large part, on the ability to control the direction and distance a golf ball travels when subjected to an inelastic collision with a golf club. To that end, the gold club includes a substantially planar face that contacts a golf ball. Optimum control of the direction and distance of travel, referred to herein as trajectory, of the golf ball is obtained by causing the same to impact with the face of the golf club at the "sweet spot". The difficulty with obtaining the skills necessary to achieve this goal frustrates the advancement in the sport of many golfers. As a result, many prior art devices have been developed to facilitate training golfers to obtain optimum control over the trajectory of a ball that is stricken with a golf club. U.S. Pat. No. 5,135,228 to Hawkins, Sr. et al. discloses a system for improving ones golf game by using a practice club with a very small head to hit practice balls that are light weight and preferably are very small in diameter. The novel practice golf club has a head or ball-hitting surface which is much smaller than a conventional golf club, such as either surface having a width of about 3.5 cm (1.4 in.) or less or even about 1.5 cm (0.6 in.) or less or a convex surface having a radius of less than about 1.25 cm (0.5 in.) or even about 0.8 cm (0.3 in.) or less. The practice balls are much lighter and preferably smaller than a conventional golf ball, such as less than about 30 g, for example about 1.9 cm (0.75 in.) in diameter and about 1.5 g or about 1.27 cm (0.5 in.) in diameter and about 1 g. This invention includes as optional components of the system mat means and net means. The invention can be embodied in the form of an adaptor to convert a conventional golf club to have the type of ball-hitting surface described above.

U.S. Pat. No. 5,207,721 to Lobdell discloses a golf putter having an elongated head with an axle adapted for supporting a pair of coaxial rotatable wheels. The putter is rolled along the wheels in the direction of a sight line to strike and direct the golf ball. The strike surface of the putter is convex to assure proper relative position between the ball and the strike surface regardless of the angular position of the putter. The wheels have a resilient outer covering to protect the putting surface and to assure that the wheels grip the putting surface and roll rather than slide as the putter is advanced.

U.S. Pat. No. 5,820,477 to Redkey et al. discloses a golf training device comprising a base member that is releasably attachable to substantially any conventional golf club. A plurality of training aids are interchangeably attachable to the base member, each of which serves to correct respective aspects of a golfer's swing and stroke.

U.S. Pat. No. 6,146,285 to Winslow discloses a putter alignment device and includes a mounting frame for engaging a putter and for aligning the device relative to the putter face. A mirror frame having a mirror, employing a novel indicating line, supported thereby is coupled pivotally to the mounting frame for aligning the putter relative to a target. A securing arrangement is adapted to engage the mounting frame at a portion thereof, extending behind the putter, and engaging another portion of the mounting frame to attach removably to the putter alignment device on the putter. Inventive sight members facilitate positioning of the eyes of the golfer relative to the target line as a part of the alignment method.

A need exists, therefore, for a device that attaches to a conventional golf club to improve a user's performance playing the game of golf.

SUMMARY OF THE INVENTION

A device and method to facilitate use of a golf club, having a face, as a system to improve a user's performance in the game of golf. The device includes a body having first and second opposed surfaces; and a clamping mechanism connected to the body to securely affix the body to the golf club, with the second surface being coextensive with the first surface and having an arcuate shape with a constant radius of curvature. In another embodiment, an indicator is present on the body and has a linear shape. The indicator extends transversely away from the face toward the second surface, bisecting the second surface. The indicator facilitates recognition of the situs on the second surface at which a user should impact a golf ball. The indicator may either be indicia or a groove formed on the body. The shape of the second surface may either be concave or convex. The clamping mechanism includes a support extending from the first surface away from the second surface and terminating in a bulwark. The bulwark extends from the support, parallel to the first surface and includes an orifice extending therethrough. In one embodiment, the orifice includes a wall having threads formed therein. A screw has threads complementary to the threads formed in the wall and reciprocates within the orifice to vary a distance between the screw and the first surface. In another embodiment, an orifice includes a smooth wall, with a rod disposed therein and is resiliently biased against the first surface.

DETAILED DESCRIPTION OF THE PREFERRED EMBODIMENTS

Figure 1:
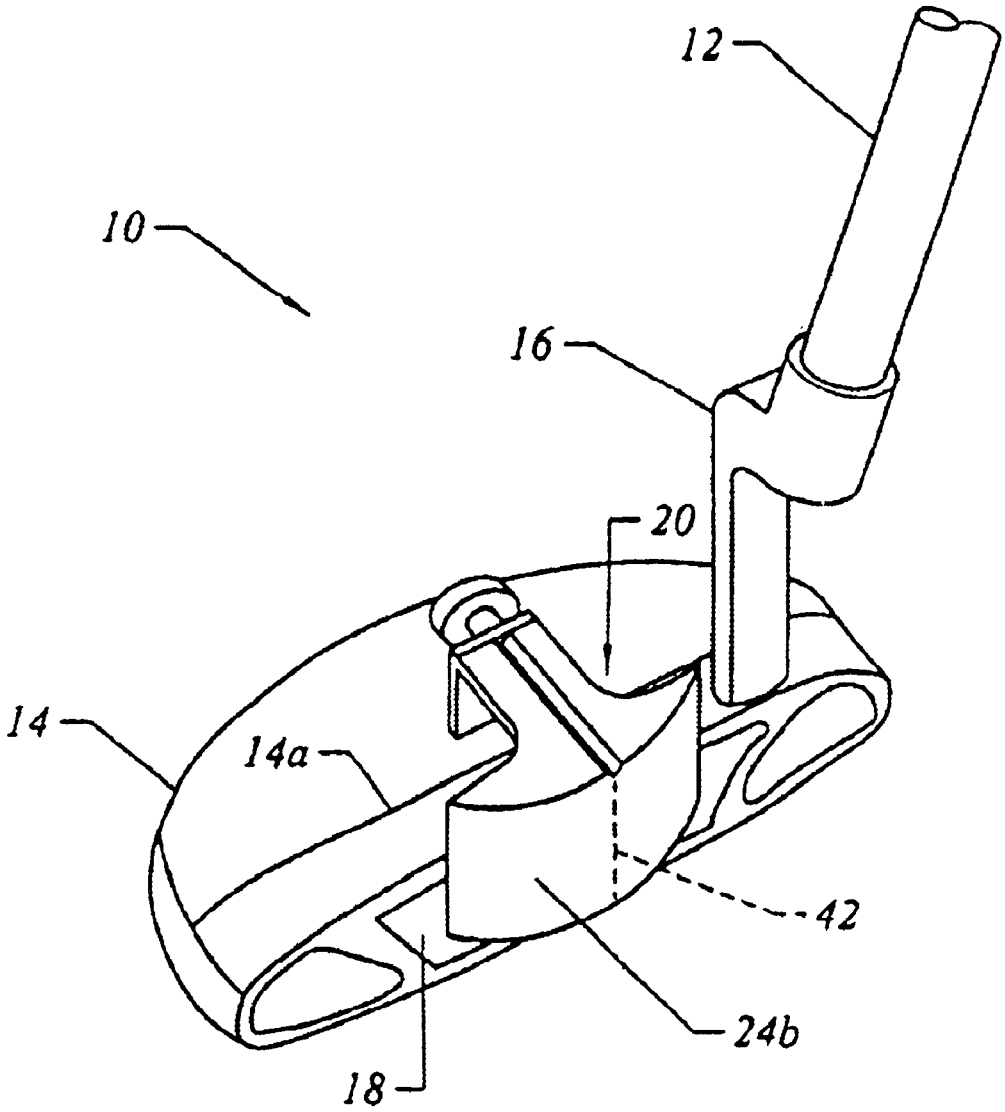
FIG. 1 is a perspective view showing a training device attached to a conventional golf club, in accordance with one embodiment of the present invention.

Referring to FIG. 1 a training system 10 includes a standard golf club, in this example a putter, which includes a handle 12 a golf club head 14 and a shank 16 coupling handle 12 to golf club head 14. Club head 14 includes a face 18, which is substantially planar. Coupled to club head 14 is a training device 20 that serves to change the contour of face 18.

Figure 2:
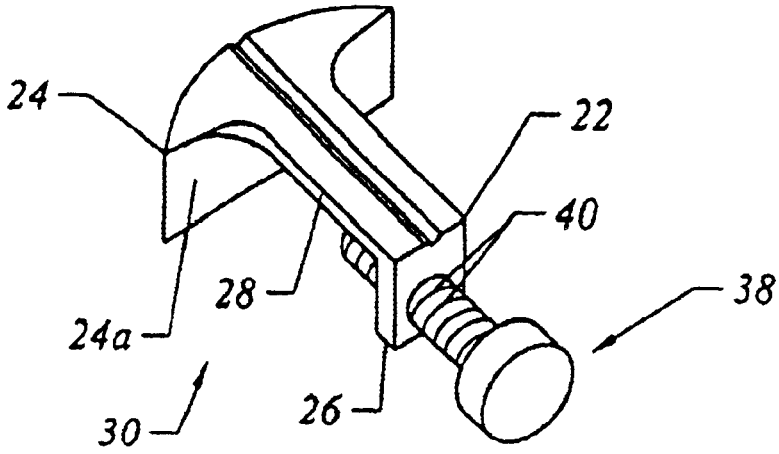
FIG. 2 is a perspective view of a training device shown in FIG. 1.

Referring to FIGS. 1 and 2, training device 20 includes a body 22 having a striking member 24, a bulwark 26 and a support member 28. Striking member 24 includes a first surface 24*a* and a second surface 24*b*, opposed to first surface 24*a*. Support member 28 extends between first surface 24*a* and bulwark 26. Striking member 24 and bulwark 26 extend from opposite ends of support member 28. Bulwark 26 is disposed opposite to striking member 24 and extends parallel thereto, with striking member 24, bulwark 26 and support member 28 defining a recess 30. A clamping mechanism is coupled to bulwark 26 to securely affix body 22 to club head 14.

Figure 3:
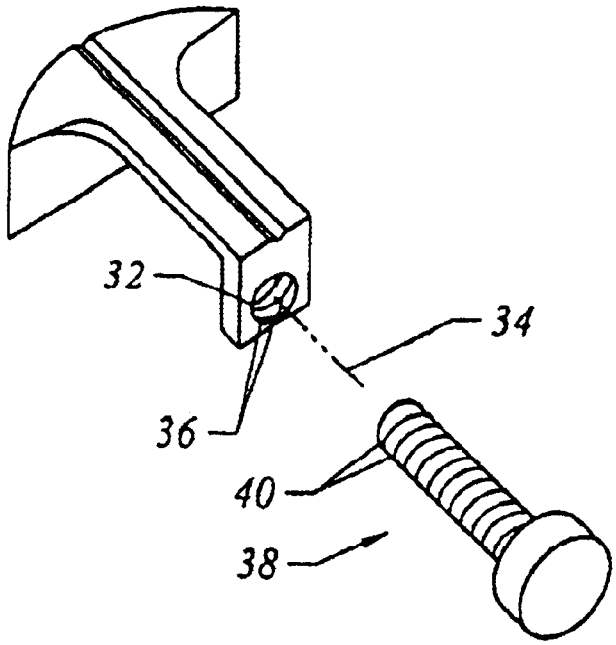
FIG. 3 is an exploded perspective view of the training device shown in FIG. 2.

Referring to FIGS. 2 and 3, clamping mechanism includes a bore 32 extending through bulwark 26 and having a longitudinal axis 34 that extends parallel to a direction that support member 28 extends. Bore 32 includes a wall having a plurality of threads 36. A screw 38 includes a plurality of threads 40 that are complementary to threads 36 so that screw 38 may be threaded within bore 32.

Referring again to FIGS. 1 and 2, club head 14 is received within recess 30 and screw 38 is rotated to affix club head 14 between screw 38 and first surface 24*a*, which faces face 18. As shown, in the present example, club head 14 includes a protrusion 14*a* extending from a surface thereof in a direction transverse to face 18 and screw 38 contacts protrusion 14*a* to define a clamping force between first surface 24*a* and screw 38. To ensure a secure fit, first surface 24*a* has a profile that is complimentary to the profile of face 18. As shown, first surface 24*a* is planar, but it may be any shape desired, dependent upon the application. The training function of training device 20 derives from the shape of second surface 24*b*. In the present example, second surface 24*b* has an arcuate shape, and more specifically, is convex.

Figure 4:
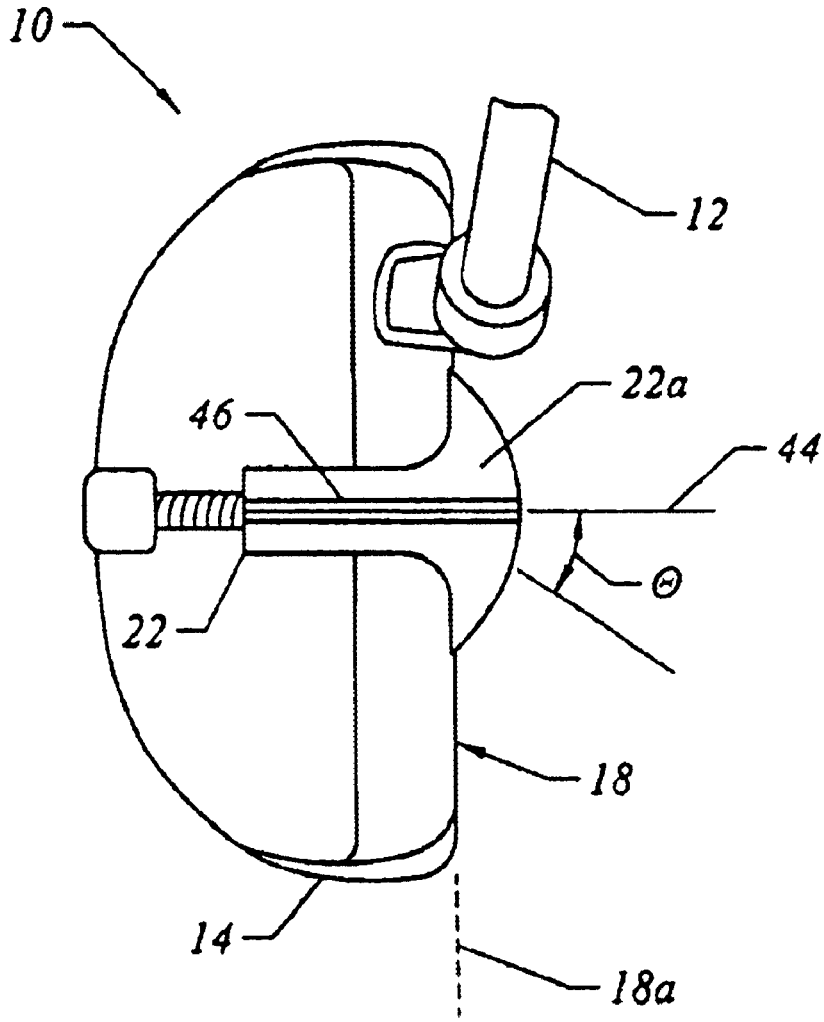
FIG. 4 is a top-down view showing the device shown in FIG. 2 mounted to a golf club, in accordance with the present invention.

Referring to both FIGS. 1 and 4, when striking a golf ball (not shown) with training system 10, a user will instantaneously know whether the proper orientation of club head 14 was present. Proper orientation results in the golf ball (not shown) traveling in a straight line in a direction orthogonal to a plane 18*a* in which face 18 lies. This is shown as direction 44. This will occur upon impacting an apex region 42 of surface 24*b* with the golf ball (not shown). The region of surface 24*b* that corresponds to apex region 42, in the present example, is approximately ⅛ of an inch wide. Were the golf ball (not shown) to strike surface 24*b* at regions other than apex region 42, the direction of travel would be at an oblique angle θ, measured with respect to direction 44. The arcuate shape exaggerates the angle θ that would ordinarily be associated with improper orientation of club head 14 impact on the golf ball (not shown) in the absence of training device 20. As a result, training device 20 provides immediate feedback with respect to proper orientation of surface 24*b*.

To assist in identifying the situs of apex region 42 on second surface 24*b*, the apex region 42 is located so as to bisect second surface 24*b*. To that end, surface 24*b* is formed as an arcuate surface with a constant radius of curvature which as shown, may define a cylindrical surface. This facilitates a user's attempt to locate the proper point on second surface 24*b* at which to strike a golf ball (not shown) without any further visual assistance.

With the training device 20, a user creates a training system employing the golf club that is used when playing golf. In this manner, a user may develop augment skill in the game of golf by training with the golf club that is employed to play golf. To that end, the screw 38, shown in FIG. 2, allows the training device 20 to be easily and quickly coupled to, and decoupled from, club head 14. One of the only noticeable changes to golf club head 14 is a slight increase in weight. To minimize the variation in weight, training device 20 may be manufactured from virtually any material, including light weight aluminum, polymer-based materials and the like. In addition, should increased weight be desired, training device 20 may be formed from steel, iron and the like.

Referring to FIG. 4, in another embodiment, a linear indicator 46 may be disposed on body 22 that indicates the location of the apex region 42, shown in FIG. 1. Linear indicator 46 is provided on a surface 22*a* of body 22 that faces handle 12 so that a user may view the same when striking the golf ball (not shown). As shown in FIG. 2, surface 22*a* extends between arcuate surface 24*a*, bulwark 26 and support member 28. The linear indicator 46 is present on surface 22*a* and extends from bulwark 26, terminating at a point proximate to second surface 24*b* and located so as to bisect second surface 24*b*, shown in FIG. 1. In one embodiment linear indicator 46 is indicia disposed on surface 22*a*. In another embodiment, linear indicator 46 may be a groove formed into surface 22*a*.

Figure 5:
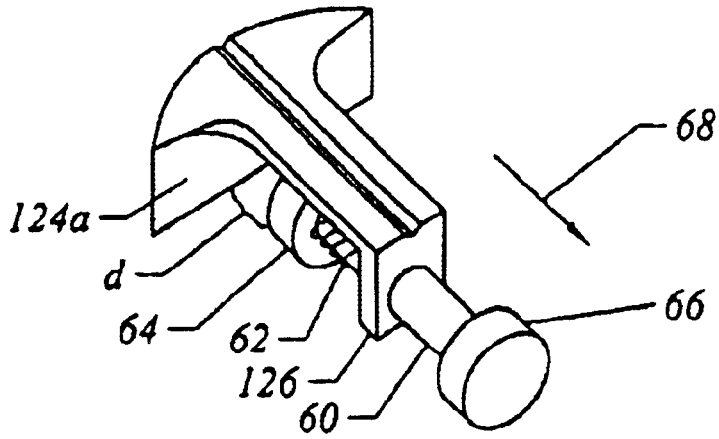
FIG. 5 is perspective view of the training device shown in FIG. 2, in accordance with an alternate embodiment.

Referring to FIG. 5, in accordance with another embodiment, the clamping mechanism may include a rod 60 that is resiliently biased to rest again first surface 124*a* via a resilient member, such as a helical spring 62. Disposed at opposing ends of rod 60 are a detent 64 and a grip 66. Detent 64 operates to hold helical spring 62 in position, between detent 64 and bulwark 126. Applying a force to grip 66 to move rod 60 along a direction 68, a distance, d, between detent 64 and first surface 124*a* may be varied.

Figure 6:
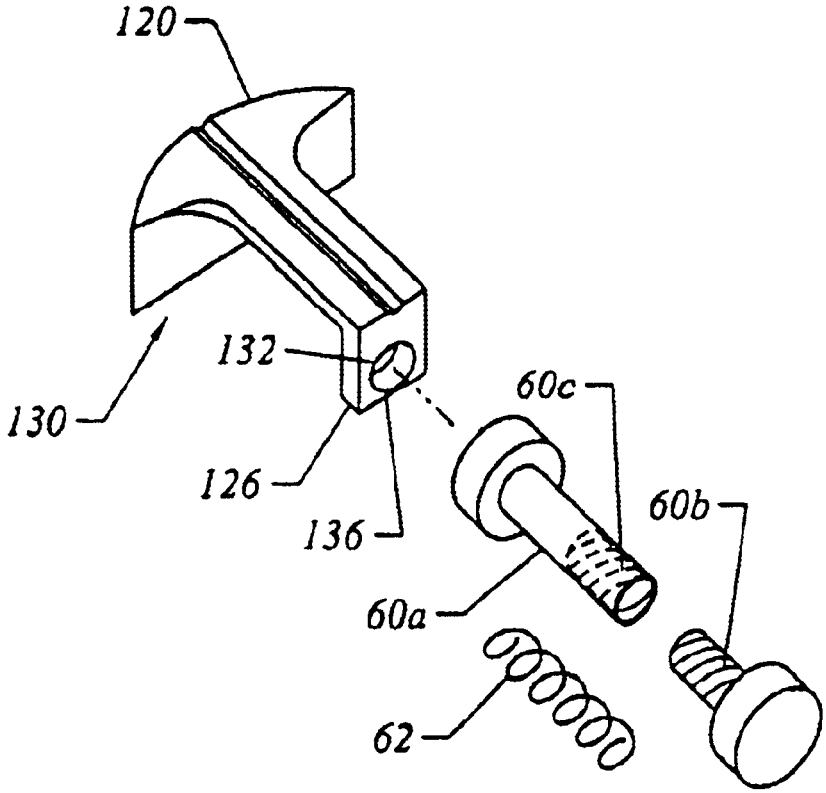
FIG. 6 is an exploded perspective view of the training device shown in FIG. 5.

Referring to FIG. 6, rod 60, shown in FIG. 5, comprises two portions, a journal portion 60*a* and a threaded portion 60*b*. Journal portion 60*a* includes a chamber 60*c* with threaded walls that are complementary to the shape of threaded portion 60*b*. Bulwark 126 includes a throughway 132 that has smooth walls 136. One manner in which to couple training device 120 together would include placing helical spring 62 on journal portion 60*a* and placing journal portion 60*a*-helical spring 62 combination in recess 130. Thereafter, threaded portion 60*b* would be threaded into chamber 60*c* through throughway 132.

Figure 7:
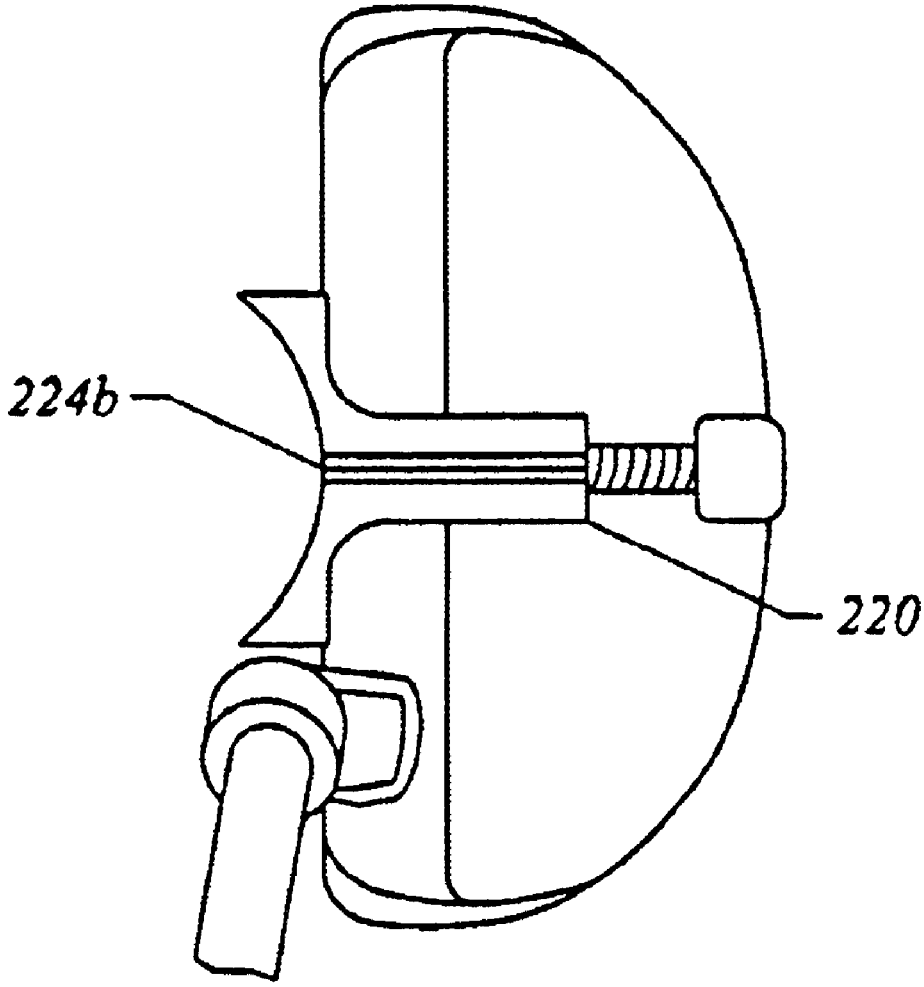
FIG. 7 is a top-down view of the training device shown in FIG. 6, in accordance with an alternate embodiment.

Referring to FIGS. 1 and 7, another embodiment of training device 20 is shown as training device 220. All features of training device 220 are the same as training device 20 except that surface 224*b*, albeit arcuate, is concave.

Although the foregoing has been discussed with respect to the use of the invention on a putter golf club, it should be understood that the present invention may be employed on any golf club design. Thus, the embodiments of the present invention described above are exemplary and the scope of the invention should, therefore, be determined not with reference to the above description, but instead should be determined with reference to the appended claims along with their full scope of equivalents.

What is claimed is:

1. A device for coupling to a golf club having a face, said device comprising:

a body having first and second opposed surfaces; and a clamping mechanism connected to said body to securely affix said body to said golf club, with said second surface being coextensive with said first surface and having a cylindrical shape with a constant radius of curvature, and said clamping mechanism including a support extending from said first surface away from said second surface and terminating in a bulwark, with said bulwark extending from said support.

2. The device as recited in claim 1 wherein said body further includes a transverse surface extending transversely to said first surface, with an indicator being present on said transverse surface, said indicator having a linear shape and extending transversely away from said face toward said second surface, bisecting said second surface.

3. The device as recited in claim 2 wherein said indicator includes indicia formed on said transverse surface.

4. The device as recited in claim 2 wherein said indicator includes a groove formed into said transverse surface.

5. The device as recited in claim 1 wherein said second surface is convex.

6. The device as recited in claim 1 wherein said second surface is concave.

7. The device as recited in claim 1 wherein said bulwark includes an orifice extending therethrough, with said bulwark extending parallel to said first surface.

8. The device as recited in claim 7 wherein said orifice includes a wall having threads formed therein and further including a screw having threads complementary to said threads formed in said wall to allow said screw to reciprocate within said orifice and vary a distance between said screw and said first surface.

9. The device as recited in claim 7 wherein said orifice includes a smooth wall, with a rod disposed therein and resiliently biased against said first surface.

10. A removably attachable device for converting a golf putter, having a club-head with a face, to a practice golf putter, said device comprising:

a body having a striking member, a bulwark and a support member, with said striking member including first and second opposed surfaces and said support member extending between said first surface and said bulwark, defining a recess; and a clamping mechanism connected to said bulwark to securely affix said body to said golf club, with said golf club being receivable within said recess with said first surface facing said face and said second surface being coextensive with said first surface and having an arcuate shape with a constant radius of curvature.

11. The device as recited in claim 10 wherein said body further includes a transverse surface extending transversely to said first surface, with an indicator being present on said transverse surface, said indicator having a linear shape and extending transversely away from said face toward said second surface, bisecting said second surface.

12. The device as recited in claim 11 wherein said indicator includes indicia formed on said transverse surface.

13. The device as recited in claim 11 wherein said indicator includes a groove formed into said transverse surface.

14. The device as recited in claim 10 wherein said second surface is convex.

15. The device as recited in claim 10 wherein said second surface is concave.

16. A removably attachable device for converting a golf putter, having a club-head with a face, to a practice golf putter, said device comprising:

a body having a striking member, a bulwark and a support member, with said striking member including first and second opposed surfaces and said support member extending between said first surface and said bulwark, defining a recess;

a clamping mechanism connected to said bulwark to securely affix said body to said golf club, with said golf club being receivable within said recess with said first surface facing said face and said second surface being coextensive with said first surface and having an arcuate shape with a constant radius of curvature; and an orifice extending through said bulwark, wherein said orifice includes a wall having threads formed therein and further including a screw having threads complementary to said threads formed in said wall to allow said screw to reciprocate within said orifice and vary a distance between said screw and said first surface.

17. The device as recited in claim 16 wherein said body further includes a transverse surface extending transversely to said first surface with an indicator being present on said transverse surface, said indicator having a linear shape and extending transversely away from said face toward said second surface, bisecting said second surface.

18. The device as recited in claim 17 wherein said indicator includes indicia formed on said transverse surface.

19. The device as recited in claim 17 wherein said indicator includes a groove formed into said transverse surface.

20. The device as recited in claim 16 wherein said second surface is selected from the group consisting of convex and concave.

* * * * *